US010201975B2

(12) United States Patent
Mizuno et al.

(10) Patent No.: US 10,201,975 B2
(45) Date of Patent: Feb. 12, 2019

(54) ACTUATOR DEVICE

(71) Applicant: BROTHER KOGYO KABUSHIKI KAISHA, Nagoya-shi, Aichi-ken (JP)

(72) Inventors: Taisuke Mizuno, Yokkaichi (JP); Hideki Hayashi, Nagoya (JP); Keita Hirai, Nagoya (JP); Yuichi Ito, Mie-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/922,327

(22) Filed: Mar. 15, 2018

(65) Prior Publication Data

US 2018/0281413 A1 Oct. 4, 2018

(30) Foreign Application Priority Data

Mar. 31, 2017 (JP) ..... 2017-070461

(51) Int. Cl.

| | |
|---|---|
| ***B41J 2/16*** | (2006.01) |
| ***B41J 2/21*** | (2006.01) |
| ***B41J 2/14*** | (2006.01) |
| ***B41J 2/345*** | (2006.01) |

(52) U.S. Cl.

CPC ..... *B41J 2/1623* (2013.01); *B41J 2/14233* (2013.01); *B41J 2/161* (2013.01); *B41J 2/2146* (2013.01); *B41J 2/345* (2013.01); *B41J 2002/14362* (2013.01); *B41J 2002/14419* (2013.01); *B41J 2002/14491* (2013.01); *B41J 2202/20* (2013.01)

(58) Field of Classification Search

CPC ..... B41J 2002/14306; B41J 2/2146; B41J 2/345; B41J 2/14233; B41J 2002/14491; B41J 2002/14419; B41J 2/1623; B41J 2002/14362; B41J 2/161; B41J 2/16; B41J 2202/20

USPC ..... 347/50

See application file for complete search history.

(56) References Cited

U.S. PATENT DOCUMENTS

| | | | | |
|---|---|---|---|---|
| 7,213,912 | B2 * | 5/2007 | Ito | B41J 2/14209 347/50 |
| 9,840,076 | B2 * | 12/2017 | Okui | B41J 2/14 |
| 2016/0031214 | A1 | 2/2016 | Okui et al. | |

FOREIGN PATENT DOCUMENTS

| | | | |
|---|---|---|---|
| JP | 2016-34739 | A | 3/2016 |

* cited by examiner

*Primary Examiner* — Jannelle M Lebron

(74) *Attorney, Agent, or Firm* — Merchant & Gould P.C.

(57) ABSTRACT

An actuator device includes an actuator substrate having actuators, individual conductors electrically connected with the actuators respectively, and dummy conductors; and a bonding member bonded to a surface of the actuator substrate provided with the individual conductors and the dummy conductors. The individual conductors are aligned in an alignment direction to form a first row and a second row arranged in an orthogonal direction orthogonal to the alignment direction. In a first end portion of the actuator substrate on one side in the alignment direction, first individual conductors are aligned in the alignment direction without intervening second individual conductors therebetween. In a second end portion of the actuator substrate on the other side in the alignment direction, the second individual conductors are aligned in the alignment direction without intervening the first individual conductors therebetween.

17 Claims, 8 Drawing Sheets

ACTUATOR DEVICE

CROSS REFERENCE TO RELATED APPLICATION

The present application claims priority from Japanese Patent Application No. 2017-070461 filed on Mar. 31, 2017, the disclosure of which is incorporated herein by reference in its entirety.

BACKGROUND

Field of the Invention

The present invention relates to an actuator device including an actuator substrate having a plurality of individual conductors and a plurality of dummy conductors, and a bonding member bonded to the actuator substrate.

Description of the Related Art

There is known an actuator device having an actuator substrate provided with first individual conductors, second individual conductors, and dummy conductors, on a surface thereof. The first individual conductors and the second individual conductors are aligned respectively in a predetermined alignment direction to form rows. In an end portion on one side in the alignment direction, the first individual conductors are aligned in the predetermined alignment direction without intervening the second individual conductors therebetween. In an end portion on the other side in the alignment direction, the second individual conductors are aligned in the predetermined alignment direction without intervening the first individual conductors therebetween. In an area between the end portion on the one side and the end portion on the other side in the predetermined alignment direction, the first individual conductors and the second individual conductors are alternately aligned in the predetermined alignment direction. The dummy conductors are provided respectively on the other side with respect to the first individual conductors in the predetermined alignment direction and on the one side with respect to the second individual conductors in the predetermined alignment direction. Further, a bonding member is bonded to a surface of the actuator substrate to contact respectively with the plurality of first individual conductors and the plurality of second individual conductors.

SUMMARY

According to above actuator device, a bonding area of the bonding member to the surface of the actuator substrate includes a first bonding area in contact with the first individual conductors, and a second bonding area in contact with the second individual conductors. The first bonding area includes an area on the other side with respect to the first individual conductors in the predetermined alignment direction, and the second bonding area includes an area on the one side with respect to the second individual conductors in the predetermined alignment direction. The dummy conductors are provided within a predetermined range in an installation area of a wiring substrate, thereby being not present in each bonding area. That is, there are no conductors present in any of the end portion of the first bonding area on the other side in the predetermined alignment direction and the end portion of the second bonding area on the one side in the predetermined alignment direction. In such a case, in each bonding area, because of the part where conductors are present and the part where no conductors are present, the bonding member is uneven in height, thereby possibly giving rise to defect in bonding the bonding member to the actuator substrate.

An object of the present teaching is to provide an actuator device with such a configuration of including conductors in an area to which a bonding member is bonded, that bonding of the bonding member to the actuator substrate is improved.

According to an aspect of the present teaching, there is provided an actuator device including: an actuator substrate having actuators, individual conductors electrically connected with the actuators respectively, and dummy conductors; and a bonding member bonded to a surface of the actuator substrate provided with the individual conductors and the dummy conductors, wherein the individual conductors are aligned in an alignment direction to form a first row and a second row which are arranged in an orthogonal direction orthogonal to the alignment direction, in a first end portion of the actuator substrate on one side in the alignment direction, first individual conductors are aligned in the alignment direction without intervening second individual conductors therebetween, the first individual conductors being included in the individual conductors and forming the first row, the second individual conductors being included in the individual conductors and forming the second row, in a second end portion of the actuator substrate on the other side in the alignment direction, the second individual conductors are aligned in the alignment direction without intervening the first individual conductors therebetween, in an area of the actuator substrate between the first end portion and the second end portion in the alignment direction, the first individual conductors and the second individual conductors are aligned alternately in the alignment direction, the dummy conductors include a first dummy conductor provided on the other side of the first individual conductors in the alignment direction, and a second dummy conductor provided on the one side of the second individual conductors in the alignment direction, a bonding area, of the bonding member, bonded to the surface includes a first bonding area and a second bonding area arranged in the orthogonal direction, the first bonding area is in contact with the first individual conductors and the first dummy conductor, and in the second bonding area is in contact with the second individual conductors and the second dummy conductor.

DESCRIPTION OF THE EMBODIMENTS

First Embodiment

Figure 1:
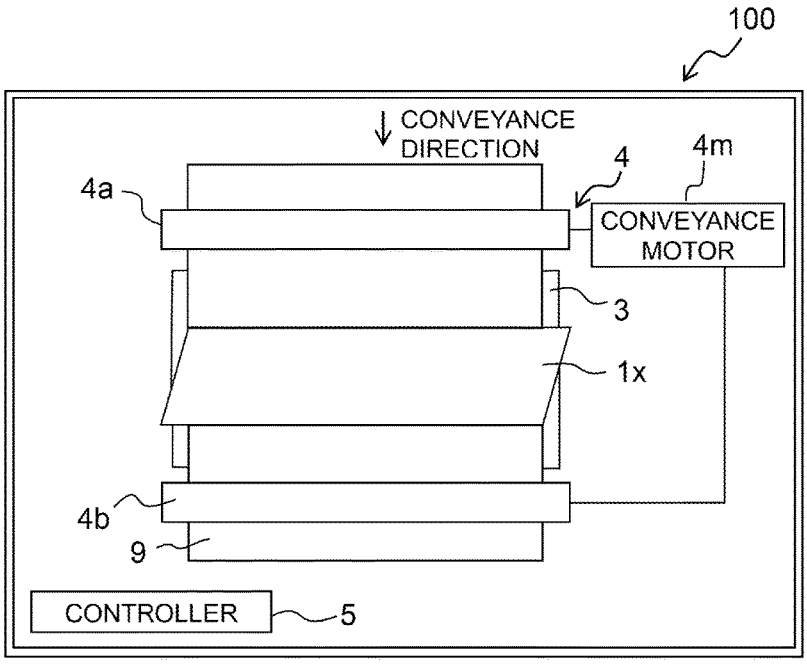
FIG. 1 is a schematic plan view of a printer provided with a head unit including a head according to a first embodiment of the present teaching.

First, referring to FIG. 1, an explanation will be made on an overall configuration of a printer 100. The printer 100 is provided with a head unit 1*x*, a platen 3, a conveyance mechanism 4, and a controller 5. The head unit 1*x* includes a head according to a first embodiment of the present teaching.

The head unit 1*x* is of a line type (that is, a type of jetting ink to paper 9 with its position being fixed), and is elongated in a direction orthogonal to a conveyance direction of the paper 9. The head unit 1*x* includes a plurality of heads 1 arranged along the direction orthogonal to the conveyance direction (see FIG. 2). The respective heads 1 correspond to the actuator device of the present teaching. The plurality of heads 1 have the same structure with each other. Each of the heads 1 jets an ink from a plurality of nozzles 11*n*.

The platen 3 is arranged below the head unit 1*x*. The ink is jetted from the respective heads 1 onto the paper 9 supported by the platen 3.

The conveyance mechanism 4 has two pairs of rollers 4*a* and 4*b* arranged across the platen 3 in the conveyance direction. A conveyance motor 4*m* drives the two rollers constituting each pair of rollers 4*a* and 4*b* to rotate in mutually opposite directions with the paper 9 nipped therebetween. By virtue of this, the paper 9 is conveyed in the conveyance direction.

Based on a recording command inputted from an external device such as a PC or the like, the controller 5 controls the plurality of heads 1, the conveyance motor 4*m* and the like to record image on the paper 9.

Figure 2:
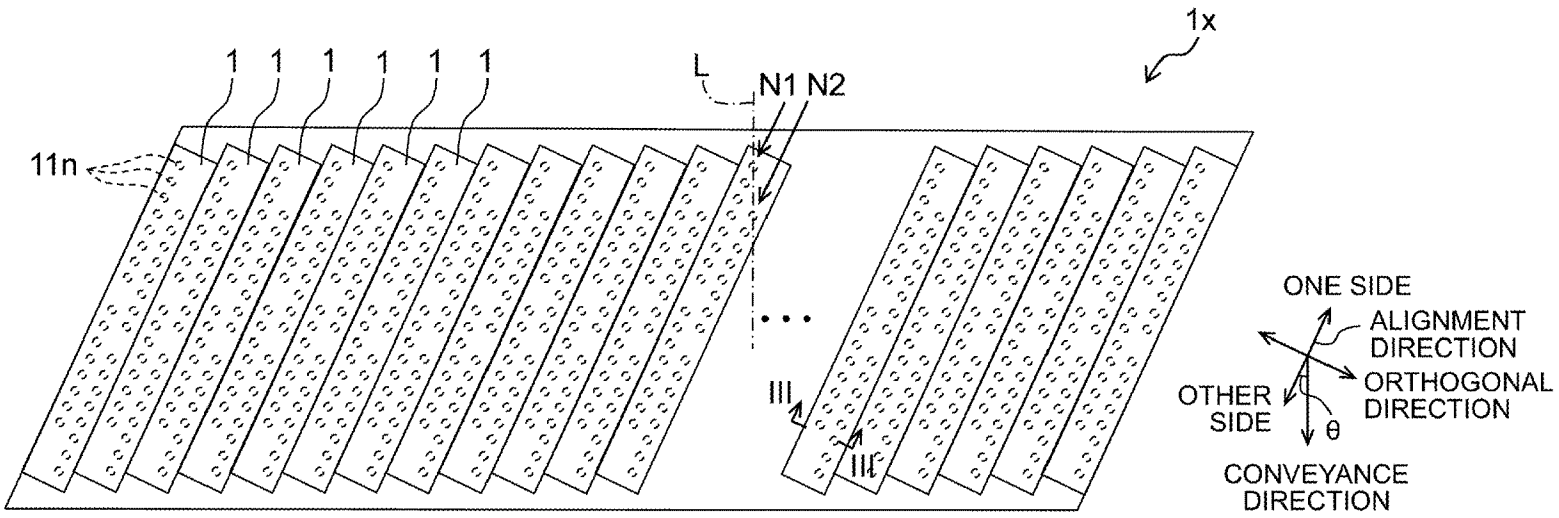
FIG. 2 is a plan view of the head unit.

Next, referring to FIG. 2, an explanation will be made on a configuration of arranging the nozzles 11*n* of each head 1.

In each head 1, the plurality of nozzles 11*n* are aligned in an alignment direction (a direction forming an acute angle θ with respect to the conveyance direction), to form two nozzle rows N1 and N2 aligning in an orthogonal direction (a direction orthogonal to the alignment direction). In this manner, with the configuration of aligning the plurality of nozzles 11*n* in a direction (the alignment direction) forming an acute angle θ (for example, at 30 to 60 degrees) with the conveyance direction, it is possible to increase the resolution of the image in the direction orthogonal to the conveyance direction, as compared with a configuration of aligning the plurality of nozzles 11*n* in the direction orthogonal to the conveyance direction.

The two nozzle rows N1 and N2 each include the same number of nozzles 11*n*, and are arranged at a certain interval in the orthogonal direction. In a direction orthogonal to the conveyance direction, the range of distributing the plurality of nozzles 11*n* included in the nozzle row N1 is in conformity with the range of distributing the plurality of nozzles 11*n* included in the nozzle row N2.

The nozzles 11*n* of each of the nozzle rows N1 and N2 conform in position with each other in a direction orthogonal to the conveyance direction. That is, each nozzle 11*n* of the nozzle row N1 and the corresponding nozzle 11*n* of the nozzle row N2 are positioned on a virtual line parallel to the conveyance direction (in FIG. 2, the upmost nozzle 11*n* of the nozzle row N1 in the conveyance direction and the upmost nozzle 11*n* of the nozzle row N2 in the conveyance direction are positioned on the virtual line L parallel to the conveyance direction). By virtue of this, it is possible to overlap, on the paper 9, the inks jetted from the nozzles 11*n* of each of the nozzle rows N1 and N2.

Each head 1 supplies inks of four colors in total: cyan (C), magenta (M), yellow (Y), and black (K). In the nozzle row N1, the ink of magenta (M) is jetted from the eight upstream nozzles 11*n* in the conveyance direction while the ink of black (K) is jetted from the eight downstream nozzles 11*n* in the conveyance direction. In the nozzle row N2, the ink of yellow (Y) is jetted from the eight upstream nozzles 11*n* in the conveyance direction while the ink of cyan (C) is jetted from the eight downstream nozzles 11*n* in the conveyance direction. In the head unit 1*x*, the plurality of nozzles 11*n* are aligned along the conveyance direction to jet the inks in the mutually different colors. By virtue of this, it is possible to overlap the four-color inks on the paper 9.

The plurality of nozzles 11*n* forming the nozzle row N1 are arranged to deviate to one side in the alignment direction so as to differ in position in the alignment direction from the plurality of nozzles 11*n* forming the nozzle row N2. In each of the nozzle rows N1 and N2, no nozzles 11*n* are formed in the center in the alignment direction (the part facing an aftermentioned dummy electrode 13*d*3 between the eight nozzles 11*n* corresponding to the respective colors).

Next, referring to FIGS. 3 to 5, the configuration of the head 1 will be explained in particular. The head 1 has a flow channel substrate 11, an actuator unit 12, a protection member 15, and a COF 18. The flow channel substrate 11 corresponds to the actuator substrate of the present teaching, the protection member 15 corresponds to the bonding member of the present teaching, and the COF 18 corresponds to the wiring substrate of the present teaching.

Figure 3:
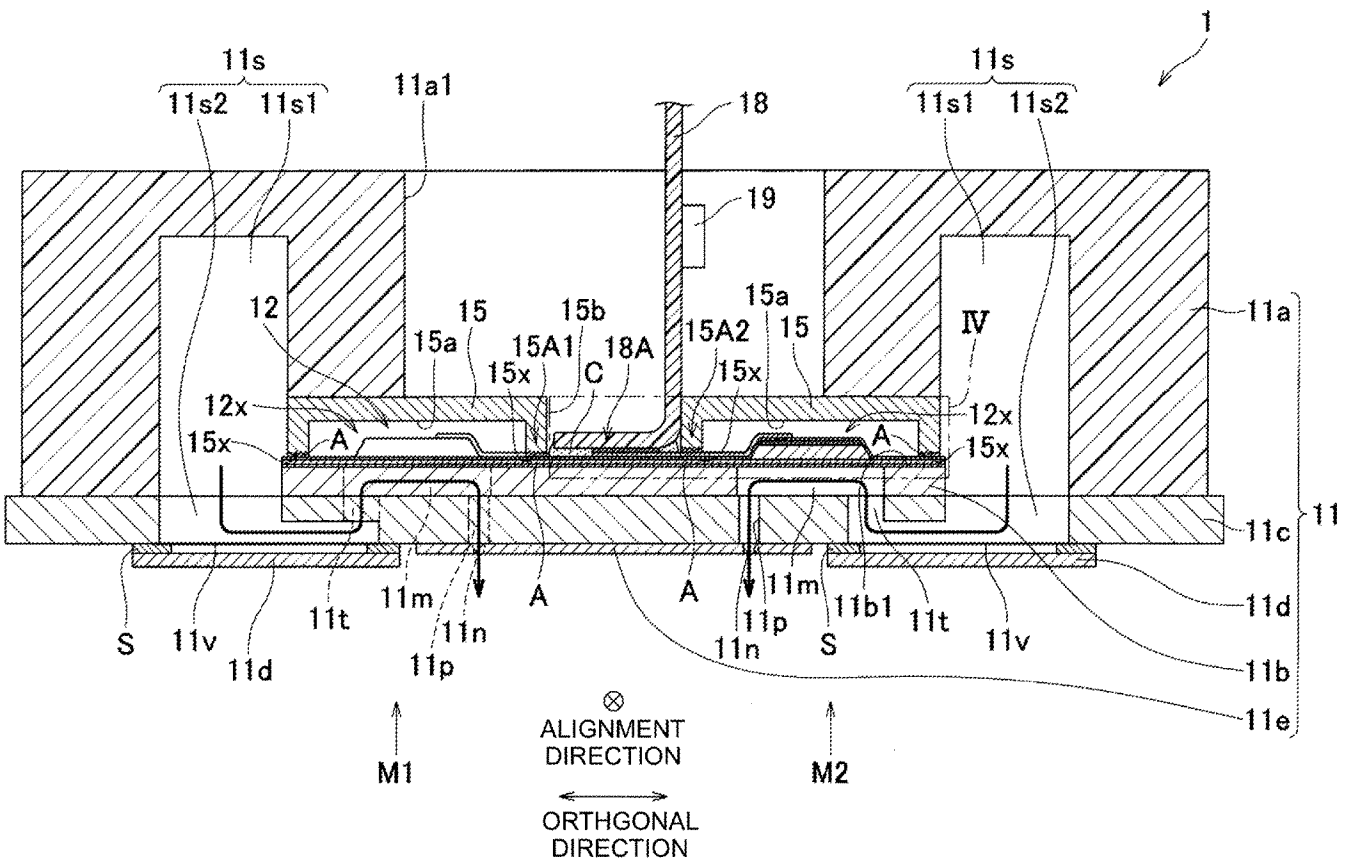
FIG. 3 is a cross-sectional view along the line III-III of FIG. 2.

As shown in FIG. 3, the flow channel substrate 11 has a reservoir member 11*a*, a pressure chamber plate 11*b*, a flow channel plate 11*c*, a protection plate 11*d*, and a nozzle plate 11*e*. These members are bonded to each other. The flow channel substrate 11 is formed therein with a plurality of pressure chambers 11*m*, the plurality of nozzles 11*n*, and a plurality of supply flow channels 11*s*.

The pressure chamber plate 11*b* is formed of a silicon single crystal substrate. The plurality of pressure chambers 11*m* are formed to penetrate through the pressure chamber plate 11*b* to communicate respectively with the plurality of nozzles 11*n* shown in FIG. 2. The plurality of pressure chambers 11*m* are, in the same manner as the plurality of nozzles 11*n*, aligned in the alignment direction to form two pressure chamber rows M1 and M2 aligning in the orthogonal direction. The pressure chamber rows M1 and M2 correspond respectively to the nozzle rows N1 and N2. The pressure chamber rows M1 and M2 forming the respective pressure chamber rows M1 and M2 are arranged in the same manner as the plurality of nozzles 11*n* forming the respective nozzle rows N1 and N2. The pressure chambers 11*m* are filled with the inks of the colors jetted from the corresponding nozzles 11*n*, respectively.

The flow channel plate 11*c* has a plane size larger than the pressure chamber plate 11*b* to some degree, and is bonded to the lower surface of the pressure chamber plate 11*b*. The flow channel plate 11*c* is formed therein with a manifold 11*s*2 which is part of the supply flow channel 11*s*, a flow channel 11*t* connecting the manifold 11*s*2 and each pressure chamber 11*m*, and a descender 11*p* connecting each pressure chamber 11*m* and the corresponding nozzle 11*n*.

A flexible damper film 11*v* is bonded to the lower surface of the flow channel plate 11*c* to cover the manifold 11*s*2. The damper film 11*v* has a function of attenuating pressure variation of the ink inside the manifold 11*s*2. A frame-like spacer S is fixed at the periphery of the damper film 11*v*.

The protection plate 11*d* is bonded to the lower surface of the spacer S to cover the damper film 11*v*. The damper film 11*v* faces the protection plate 11*d* across an interspace, and is protected by the protection plate 11*d*.

The nozzle plate 11*e* is formed with the plurality of nozzles 11*n* penetrating through the nozzle plate 11*e*. The nozzle plate 11*e* is bonded to the lower surface of the flow channel plate 11*c*.

The reservoir member 11*a* is formed with the reservoir 11*s*1 which is part of the supply flow channel 11*s*. The reservoir 11*s*1 opens at the lower surface of the reservoir member 11*a*. The reservoir member 11*a* is bonded to the upper surface of the flow channel plate 11*c* and on the upper surface of the protection member 15 such that the reservoir 11*s*1 overlaps with the manifold 11*s*2.

The supply flow channel 11*s* is provided independently for each color of the ink. That is, a supply flow channel 11*s* is provided to supply the ink of magenta (M) and another supply flow channel 11*s* is provided to supply the ink of black (K) to the pressure chamber row M1, while a supply flow channel 11*s* is provided to supply the ink of yellow (Y) and another supply flow channel 11*s* is provided to supply the ink of cyan (C) to the pressure chamber row M2. Each supply flow channel 11*s* is in communication with a tank retaining the ink of the corresponding color via a tube or the like. The ink in each tank flows into the supply flow channel 11*s* by the drive of a pump (not shown), and is supplied to the plurality of corresponding pressure chambers 11*m*.

Figure 4:
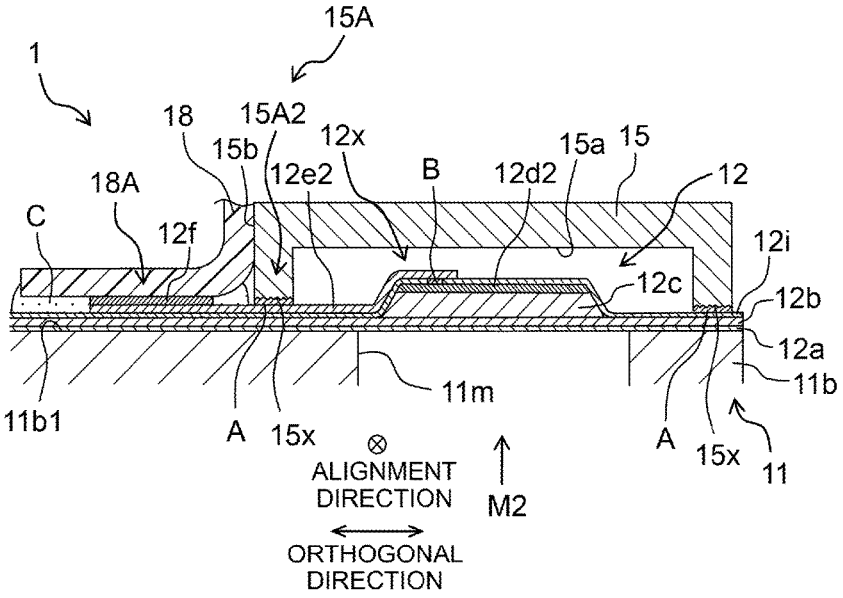
FIG. 4 depicts the area IV of FIG. 3.

The actuator unit 12 is arranged, as shown in FIG. 4, on an upper surface 11*b*1 of the pressure chamber plate 11*b*. The actuator unit 12 includes, in order from below, a vibration plate 12*a*, a common electrode 12*b*, a plurality of piezoelectric bodies 12*c*, and a plurality of individual electrodes 12*d*1 and 12*d*2 (see FIG. 5).

The vibration plate 12*a* and the common electrode 12*b* are formed on almost the entire upper surface 11*b*1 of the pressure chamber plate 11*b* to cover the plurality of pressure chambers 11*m*. On the other hand, the plurality of piezoelectric bodies 12*c* and the plurality of individual electrodes 12*d*1 and 12*d*2 are arranged respectively for the pressure chambers 11*m* (that is, to face the plurality of pressure chambers 11*m* respectively).

The vibration plate 12*a* is a film of silicon dioxide formed by oxidizing a surface of the silicon single crystal substrate used to form the pressure chamber plate 11*b*. The common electrode 12*b* is used commonly for the plurality of pressure chambers 11*m*, and arranged between the vibration plate 12*a* and the plurality of piezoelectric bodies 12*c* to face the plurality of pressure chambers 11*m*. The plurality of piezoelectric bodies 12*c* are made of a piezoelectric material such as lead zirconate titanate (or PZT) or the like, and arranged on the upper surface of the common electrode 12*b* to face the plurality of pressure chambers 11*m* respectively. The plurality of individual electrodes 12*d*1 and 12*d*2 are formed on the upper surfaces of the plurality of piezoelectric bodies 12*c*, respectively. The individual electrodes 12*d*1 and 12*d*2 are arranged respectively to face the pressure chambers 11*m* forming the pressure chamber rows M1 and M2.

The parts of each piezoelectric body 12*c* interposed between the individual electrodes 12*d*1 and the common electrode 12*b* and between the individual electrodes 12*d*2 and the common electrode 12*b* function as an actuator 12*x* deformable with an application of voltage to the individual electrodes 12*d*1 and 12*d*2. That is, the actuator unit 12 has a plurality of actuators 12*x* covering the plurality of pressure chambers 11*m* respectively. By driving the actuators 12*x* facing the pressure chambers 11*m* (that is, by deforming the actuators 12*x* with the application of voltage to the individual electrodes 12*d*1 or the individual electrodes 12*d*2 (such as becoming convex toward the pressure chambers 11*m*)), those pressure chambers 11*m* change in volume such that the inks inside the pressure chambers 11*m* are assigned with a pressure, thereby being jetted from the nozzles 11*n*.

Figure 5:
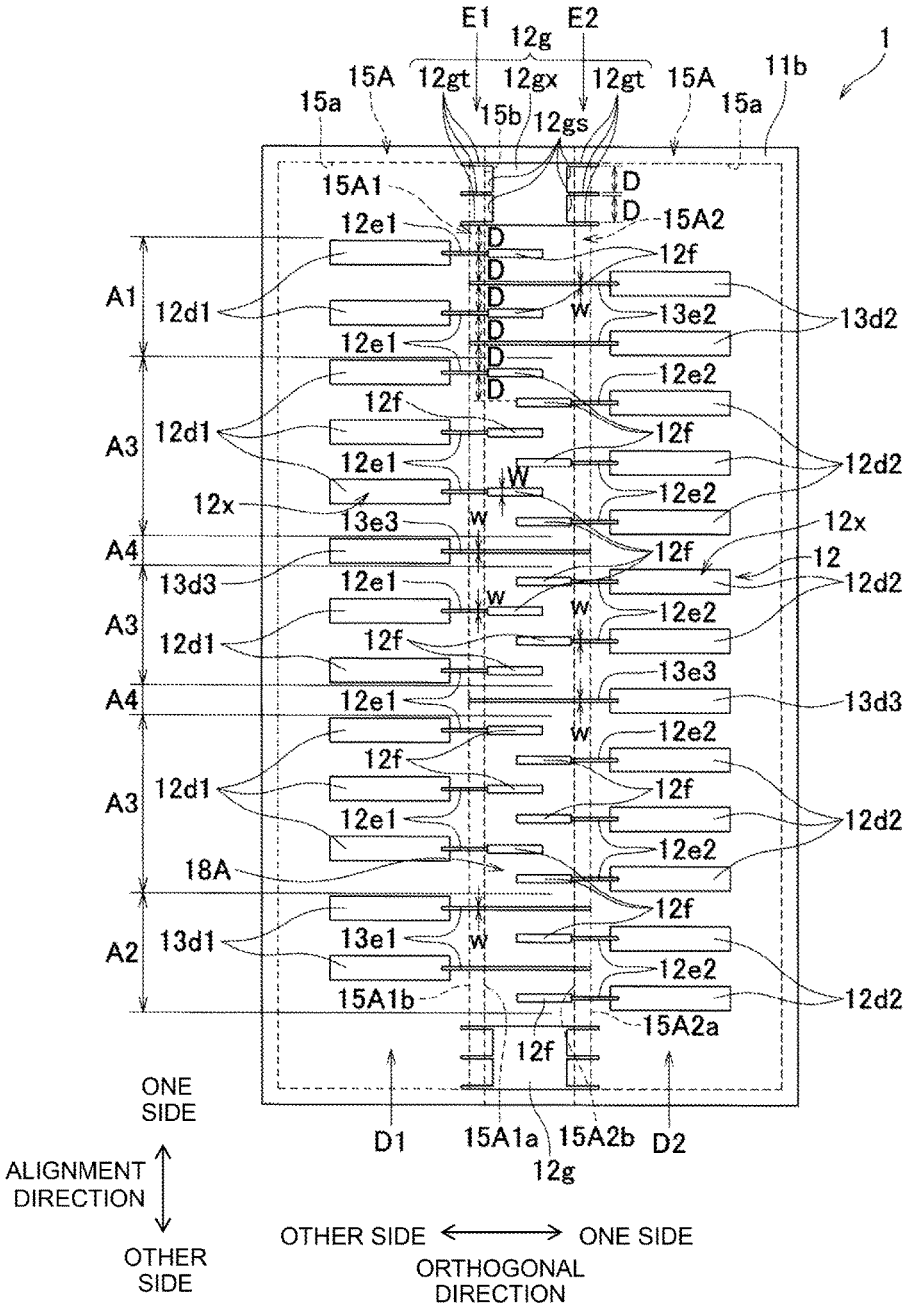
FIG. 5 is a plan view of a head (omitting illustration of a reservoir member, a flow channel plate, a protection plate, a nozzle plate, and a protection films).

As shown in FIG. 5, the plurality of individual electrodes 12*d*1 and the plurality of individual electrodes 12*d*2 are aligned respectively in the alignment direction to form two individual electrode rows D1 and D2 aligning in the orthogonal direction. The individual electrode row D1 corresponds to the nozzle row N1 and the pressure chamber row M1 while the individual electrode row D2 corresponds to the nozzle row N2 and the pressure chamber row M2. The plurality of individual electrodes 12*d*1 forming the individual electrode row D1 are arranged to deviate to one side in the alignment direction from the plurality of individual electrodes 12*d*2 forming the individual electrode row D2, to differ therefrom in position in the alignment direction. Two dummy electrodes 13*d*1 and 13*d*2 are provided respectively in the blank areas formed from such deviated arrangement (in particular, one on the other side of the individual electrode 12*d*1 in the alignment direction and the other on the one side of the individual electrode 12*d*2 in the alignment direction, respectively). Further, a dummy electrode 13*d*3 is provided in the center of each of the individual electrode rows D1 and D2 in the alignment direction. The supply flow channels 11*s* of mutually different ink colors (see FIG. 3) are provided to interpose the dummy electrodes 13*d*3 in the alignment direction, in the respective individual electrode rows D1 and D2. That is, in the individual electrode row D1, between the individual electrodes 12*d*1 on the one side in the alignment direction and the individual electrodes 12*d*1 on the other side with respect to the dummy electrode 13*d*3, the colors of the inks filling the opposed pressure chambers 11*m* (see FIG. 3) are different. Likewise, in the individual electrode row D2, between the individual electrodes 12*d*2 on the one side in the alignment direction and the individual electrodes 12*d*2 on the other side with respect to the dummy electrode 13*d*3, the colors of the inks filling the opposed pressure chambers 11*m* (see FIG. 3) are different, too.

The dummy electrodes 13*d*1 to 13*d*3 have the same size and the same shape as the individual electrodes 12*d*1 and 12*d*2. In the individual electrode row D1, the individual electrodes 12*d*1 and the dummy electrodes 13*d*1 and 13*d*3 are aligned at regular intervals. In the individual electrode row D2, the individual electrodes 12*d*2 and the dummy electrodes 13*d*2 and 13*d*3 are aligned at regular intervals, too.

In positions facing the dummy electrodes 13*d*1 to 13*d*3, the piezoelectric bodies 12*c* are arranged but the pressure chambers 11*m* and the nozzles 11*n* are not arranged.

A protection film 12*i* is provided (see FIG. 4) to cover the upper surface of each of the individual electrodes 12*d*1 and 12*d*2, the upper surface of each of the dummy electrodes 13*d*1 to 13*d*3, such parts of the upper surface of the common electrode 12*b* as not provided with the piezoelectric bodies 12*c*, and the lateral surface of each piezoelectric body 12*c*. The protection films 12*i* are provided for protecting the piezoelectric bodies 12*c* and have a function to prevent moisture in the air from coming into the piezoelectric bodies 12*c*. The protection films 12*i* are made of, for example, aluminum oxide (alumina: $Al_2O_3$), or the like. Through holes are formed in such parts of the protection films 12*i* as facing the respective electrodes 12*d*1, 12*d*2, and 13*d*1 to 13*d*3.

The respective electrodes 12*d*1, 12*d*2, and 13*d*1 to 13*d*3 are connected to individual conductors 12*e*1, 12*e*2, and dummy conductors 13*e*1 to 13*e*3 via a conductive material B filling the through holes of the protection films 12*i* (see FIGS. 4 and 5). As shown in FIG. 5, the individual conductors 12*e*1 and 12*e*2 are connected respectively with the individual electrodes 12*d*1 and 12*d*2, and connected electrically with the respective actuators 12*x*. The dummy conductors 13*e*1 to 13*e*3 are connected respectively with the dummy electrodes 13*d*1 to 13*d*3, but are not connected electrically with the respective actuators 12*x*.

Further, as described above, the piezoelectric bodies 12*c* are arranged in the positions facing the dummy electrodes 13*d*1 to 13*d*3. Therefore, in the same manner as the actuators 12*x*, those piezoelectric bodies 12*c* are also deformable in the parts interposed between the dummy electrodes 13*d*1 to 13*d*3 and the common electrode 12*b*, with an application of voltage. However, because no drive signal is supplied to the dummy electrodes 13*d*1 to 13*d*3, the voltage is not applied to the above parts which are thus not driven. Further, because neither pressure chambers 11*m* nor nozzles 11*n* are formed in the positions facing the dummy electrodes 13*d*1 to 13*d*3, even if the above parts were driven, they would still make no contributions to jetting the inks.

The individual conductors 12*e*1 and 12*e*2 are arranged in the alignment direction to form a first row E1 and a second row E2 aligning in the orthogonal direction. The plurality of first individual conductors 12*e*1 forming the first row E1 are arranged to deviate to one side in the alignment direction so as to differ in position in the alignment direction from the plurality of second individual conductors 12*e*2 forming the second row E2. Two dummy conductors 13*e*1 and 13*e*2 (hereinbelow, the first dummy conductor 13*e*1 will be used to refer to the dummy conductor provided on the other side of the first individual conductors 12*e*1 in the alignment direction while the second dummy conductor 13*e*2 will be used to refer to the dummy conductor provided on the one side of the second individual conductors 12*e*1 in the alignment direction) are provided respectively in the blank areas formed from such deviated arrangement (in particular, one on the other side of the first individual conductors 12*e*1 forming the first row E1 in the alignment direction and the other on the one side of the second individual conductors 12*d*2 forming the second row E2 in the alignment direction, respectively). Further, a dummy conductor 13*e*3 is provided in the center of each of the rows E1 and E2.

Because of arranging the first individual conductors 12*e*1 forming the first row E1 and the second individual conductors 12*e*2 forming the second row E2 in the above deviated manner, in an area A1 on one end side in the alignment direction, the first individual conductors 12*e*1 are aligned in the alignment direction without intervening the second individual conductors 12*e*2 therebetween, while in an area A2 on the other end side in the alignment direction, the second individual conductors 12*e*2 are aligned in the alignment direction without intervening the first individual conductors 12*e*1 therebetween. Between the areas A1 and A2 (between the one end portion and the other end portion), an area A3 of aligning the first individual conductors 12*e*1 and the second individual conductors 12*e*2 alternately in the alignment direction and an area A4 of aligning the dummy conductors 13*e*3 are formed alternately in the alignment direction.

The conductors 12*e*1, 13*e*1, and 13*e*3 belonging to the first row E1 extend in the orthogonal direction from the first row E1 toward the second row E2. The conductors 12*e*2, 13*e*2, and 13*e*3 belonging to the second row E2 extend in the orthogonal direction from the second row E2 toward the first row E1. The conductors 12*e*1, 12*e*2, and 13*e*1 to 13*e*3 have the same width w (the length along the alignment direction) with each other. The width w is constant along the orthogonal direction.

An individual contact point 12*f* is formed at the fore-end of each of the individual conductors 12*e*1 and 12*e*2. No individual contact point 12*f* is formed at the fore-end of each of the dummy conductors 13*e*1 to 13*e*3. Each of the individual contact points 12*f* constitutes the individual conductor of the present teaching, and has a width W larger than the width w of the respective individual conductors 12*e*1 and 12*e*2.

A pair of common contact points 12*g* are provided to interpose the individual contact points 12*f* in the alignment direction. The common contact points 12*g* correspond to the common conductor of the present teaching, and are provided respectively on the other side with respect to the first dummy conductors 13*e*1 in the alignment direction and on the one side with respect to the second dummy conductors 13*e*2 in the alignment direction. Each common contact point 12*g* is connected electrically with the common electrode 12*b* via a conductive material (not shown) filling a through hole penetrating the protection film 12*i*. That is, each common contact point is connected electrically with the plurality of actuators 12*x*. The plurality of individual conductors 12*e*1 and 12*e*2, the plurality of dummy conductors 13*e*1 to 13*e*3, and the common contact points 12*g* are aligned at regular intervals (interval D) in the alignment direction.

Each common contact point 12*g* includes a base 12*gx* and six terminals 12*gt*. The terminals 12*gt* are provided to distance each other in the alignment direction, three at one side and three at the other side of the base 12*gx* in the orthogonal direction. Each terminal 12*gt* has the same width as the respective conductors 12*e*1, 12*e*2, and 13*e*1 to 13*e*3. Further, the corresponding terminals 12*gt* have the same interval D in the alignment direction as the conductors 12*e*1, 12*e*2, and 13*e*1 to 13*e*3. That is, the terminals 12*gt* and the conductors 12*e*1, 12*e*2, and 13*e*1 to 13*e*3 having the same width with each other are aligned at the regular intervals (interval D) in the alignment direction.

Notches 12*gs* are formed between the terminals 12*gt*, one at one side and the other at the other side of each common contact point 12*g* in the orthogonal direction. Each notch 12*gs* extends in the orthogonal direction between the terminals 12*gt* adjacent in the alignment direction. By virtue of this, the spaces between the terminals 12*gt* are in communication with the outside of the common contact points 12*g*.

As shown in FIG. 3, the protection member 15 has a pair of concave portions 15*a* extending respectively in the alignment direction. Each concave portion 15*a* opens at the lower surface of the protection member 15. The protection member 15 is bonded the upper surface 11*b*1 of the pressure chamber plate 11*b* with an adhesive A via the vibration plate 12*a*, the common electrode 12*b* and the protection films 12*i*. The plurality of piezoelectric bodies 12*c* corresponding to the pressure chamber rows M1 and M2 are accommodated inside the concave portions 15*a*. A convexoconcave 15*x* is formed on the surface of the protection member 15 to face the upper surface 11*b*1 of the pressure chamber plate 11*b*.

The protection member 15 has a through hole 15*b* at the center in the orthogonal direction. The reservoir member 11*a* has a through hole 11*a*1 at the center in the orthogonal direction. The plurality of individual contact points 12*f* and the bases 12*gx* of the pair of common contact points 12*g* are exposed from the through holes 15*b* and 11*a*1.

One end of the COF 18 is bonded with an adhesive C to the upper surface 11*b*1 of the pressure chamber plate 11*b*, and connected electrically with the respective contact points 12*f* and 12*g*. The COF 18 passes through the through holes 15*b* and 11*a*1 and extends upward to let the other end be connected electrically with the controller 5 (see FIG. 1).

A driver IC 19 is mounted between the one end and the other end of the COF 18. The driver IC 19 is connected electrically with each of the contact points 12*f* and 12*g* and the controller 5 via wires (not shown) formed on the COF 18. Based on a signal from the controller 5, the driver IC 19 generates a drive signal for driving the actuators 12*x*, and supplies the drive signal to the respective individual electrodes 12*d*1 and 12*d*2 via the respective individual conductors 12*e*1 and 12*e*2. The common electrode 12*b* is maintained at the ground potential. On the other hand, the drive signal is not supplied to the dummy conductors 13*e*1 to 13*e*3 and the dummy electrodes 13*d*1 to 13*d*3.

As shown in FIG. 5, bonding areas 15A of the protection member 15 on the upper surface 11*b*1 of the pressure chamber plate 11*b* are a pair of areas shaped like rectangular frames aligning in the orthogonal direction across the through hole 15*b*. In the pair of bonding areas 15, a first bonding area 15A1 and a second bonding area 15A2 face each other in the orthogonal direction, and extend respectively in the alignment direction to align in the orthogonal direction.

The first bonding area 15A1 is in contact with the first individual conductor 12*e*1, the first dummy conductor 13*e*1, the dummy conductor 13*e*3 in the first row E1, and the terminals 12*gt* of the pair of common contact points 12*g* at the other side in the orthogonal direction. The second bonding area 15A2 is in contact with the second individual conductor 12*e*2, the second dummy conductor 13*e*2, the dummy conductor 13*e*3 in the second row E2, and the terminals 12*gt* of the pair of common contact points 12*g* at the one side in the orthogonal direction. The first dummy conductor 13*e*1 is positioned in the end portion of the first bonding area 15A1 at the other side in the alignment direction. The second dummy conductor 13*e*2 is positioned in the end portion of the second bonding area 15A2 at the one side in the alignment direction.

The first individual conductor 12*e*1, the first dummy conductor 13*e*1, the dummy conductor 13*e*3 in the first row E1, and the terminals 12*gt* of the pair of common contact points 12*g* at the other side in the orthogonal direction extend respectively from one end 15A1*a* of the first bonding area 15A1 to another end 15A1*b* in the orthogonal direction. The second individual conductor 12*e*2, the second dummy conductor 13*e*2, the dummy conductor 13*e*3 in the second row E2, and the terminals 12*gt* of the pair of common contact points 12*g* at the one side in the orthogonal direction extend respectively from an end 15A2*a* of the second bonding area 15A2 to another end 15A2*b* in the orthogonal direction. That is, the respective conductors 12*e*1, 12*e*2, and 13*e*1 to 13*e*3 exist across the entire width of the respective bonding areas 15A1 and 15A2. Further, because the conductors 12*e*1, 12*e*2, and 13*e*1 to 13*e*3 have the same width w with one another, the conductors 12*e*1, 12*e*2, and 13*e*1 to 13*e*3 in the bonding areas 15A have the same area with one another.

The first individual conductors 12*e*1 and the second individual conductors 12*e*2 have the same length along the orthogonal direction with each other. The dummy conductors 13*e*1 to 13*e*3 also have the same length along the orthogonal direction with each other, and longer than the individual conductors 12*e*1 and 12*e*2 along the orthogonal direction. The respective dummy conductors 13*e*1 to 13*e*3 extend across the first bonding area 15A1 and the second bonding area 15A2.

As shown in FIG. 5, a bonding area 18A of the COF 18 (see FIGS. 3 and 4) on the upper surface 11*b* 1 of the pressure chamber plate 11*b* is present between the first bonding area 15A1 and the second bonding area 15A2. In the bonding area 18A, the width w of the respective dummy conductors 13*e*1 to 13*e*3 is narrower than the width W of the respective individual conductors 12*e*1 and 12*e*2 including the individual contact points 12*f*.

As described above, according to the first embodiment, the first dummy conductors 13*e*1 and the second dummy conductors 13*e*2 are provided to face the first bonding area 15A1 and second bonding area 15A2 of the protection member 15. In particular, the first dummy conductors 13*e*1 are provided at the other side of the first individual conductors 12*e*1 forming the first row E1 in the alignment direction, while the second dummy conductors 13*e*2 are provided at the one side of the second individual conductor 12*e*2 forming the second row E2 in the alignment direction. That is, the first dummy conductors 13*e*1 and the second dummy conductors 13*e*2 are provided respectively in the areas formed by arranging the first individual conductors 12*e*1 forming the first row E1 to deviate from the second individual conductors 12*e*2 forming the second row E2 (see FIG. 5). By virtue of this, the protection member 15 is prevented from unevenness in height due to the presence or absence of the conductors 12*e*1, 12*e*2, and 13*e*1 to 13*e*3 (that is, convex portions), thereby improving the bonding of the protection member 15 to the flow channel substrate 11.

The first dummy conductors 13*e*1 are provided to face an end portion of the first bonding area 15A1 on the other side in the alignment direction, while the second dummy conductors 13*e*2 are provided to face an end portion of the second bonding area 15A2 on the one side in the alignment direction (see FIG. 5). Although the end portions of the bonding areas 15A are especially liable to detachment, in the first embodiment, because the dummy conductors 13*e*1 and 13*e*2 form concavity and convexity in positions facing the end portions. Therefore, not only is an anchor obtainable, but the contact area with the adhesive A (see FIG. 4) also increases. By virtue of this, it is possible to raise the strength of bonding the end portions, thereby preventing detachment.

The first dummy conductors 13*e*1 extend from the end 15A1*a* of the first bonding area 15A1 in the orthogonal direction to the other end 15A1*b*, while the second dummy conductors 13*e*2 extend from one end to the other end of the second bonding area 15A2 in the orthogonal direction (see FIG. 5). In this case, even if the protection member 15 deviates in position in the orthogonal direction, it is still possible to realize a configuration for the dummy conductors 13*e*1 and 13*e*2 to exist in positions facing the respective bonding areas 15A1 and 15A2.

The first dummy conductors 13*e*1 and the second dummy conductors 13*e*2 extend respectively across the first bonding area 15A1 and the second bonding area 15A2 (see FIG. 5). That is, both the first dummy conductors 13*e*1 and the second dummy conductors 13*e*2 are present in positions facing the respective bonding areas 15A1 and 15A2. In this case, compared to the case where only the first dummy conductors 13*e*1 or only the second dummy conductors 13*e*2 are present in the respective bonding areas 15A1 and 15A2, more concavities and convexities are formed in the respective bonding areas 15A1 and 15A2 due to the dummy conductors 13*e*1 and 13*e*2. By virtue of this, many concavities and convexities enable obtainment of the anchor effect and the effect of increasing the contact areas with the adhesive A (see FIG. 4), thereby bringing in a good bonding of the protection member 15 to the flow channel substrate 11.

The individual conductors 12*e*1 and 12*e*2 and the dummy conductors 13*e*1 to 13*e*3 are aligned at regular intervals (interval D) in the alignment direction (see FIG. 5). In this case, not only is it easy to form the conductors 12*e*1, 12*e*2, and 13*e*1 to 13*e*3, but it is also possible to prevent variation in distribution of the conductors 12*e*1, 12*e*2, and 13*e*1 to 13*e*3 in positions facing the respective bonding areas 15A1 and 15A2 in the alignment direction, thereby enabling the bonding of the protection member 15 evenly to the flow channel substrate 11 in the alignment direction. By virtue of this, an even strength of bonding is obtainable in the alignment direction, thereby bringing in a better bonding of the protection member 15 to the flow channel substrate 11.

The respective bonding areas 15A1 and 15A2 are not only in contact with the individual conductors 12*e*1 and 12*e*2 and the dummy conductors 13*e*1 to 13*e*3 but also in contact with the common contact points 12*g* (see FIG. 5). In this case, the bonding areas 15A1 and 15A2 become larger in bonding area, thereby bringing in a better bonding of the protection member 15 to the flow channel substrate 11.

The individual conductors 12*e*1 and 12*e*2, the dummy conductors 13*e*1 to 13*e*3 and the common contact points 12*g* are aligned at regular intervals (interval D) in the alignment direction (see FIG. 5). In this case, because of aligning, at regular intervals, all of the individual conductors 12*e*1 and 12*e*2, the dummy conductors 13*e*1 to 13*e*3 and the common contact points 12*g* in positions facing the respective bonding areas 15A1 and 15A2, it is possible to evenly bond the protection member 15 to the flow channel substrate 11 in the alignment direction. By virtue of this, an even strength of bonding is obtainable in the alignment direction, thereby bringing in a better bonding of the protection member 15 to the flow channel substrate 11.

The respective bonding areas 15A1 and 15A2 are in contact with the terminals 12*gt* of the common contact points 12*g* (see FIG. 5). In this case, the adhesive A (see FIG. 4) comes between the terminals 12*gt*, thereby bringing in a better bonding of the protection member 15 to the flow channel substrate 11.

The interval D along the alignment direction between the corresponding individual conductors 12*e*1 and 12*e*2 is the same as the interval D along the alignment direction between the corresponding terminals 12*gt* (see FIG. 5). In this case, it is possible to further prevent variation in the conductor distribution in positions facing the respective bonding areas 15A1 and 15A2, thereby more evenly bonding the protection member 15 to the flow channel substrate 11. By virtue of this, an even strength of bonding is obtainable in the alignment direction, thereby bringing in a better bonding of the protection member 15 to the flow channel substrate 11.

Further, the respective terminals 12*gt* have the same width as the respective conductors 12*e*1, 12*e*2, and 13*e*1 to 13*e*3. The terminals 12*gt* and the conductors 12*e*1, 12*e*2, and 13*e*1 to 13*e*3 having the same width are aligned at regular intervals (interval D) in the alignment direction. In this case, it is possible to more evenly bond the protection member 15 to the flow channel substrate 11 in the alignment direction. By virtue of this, an even strength of bonding is more reliably obtainable in the alignment direction, thereby bringing in a better bonding of the protection member 15 to the flow channel substrate 11.

The common contact points 12*g* are formed with the notches 12*gs* to extend respectively between the terminals 12*gt* in the orthogonal direction (see FIG. 5). In this case, it is possible to let out any excessive adhesive A (see FIG. 4) between the terminals 12*gt* through the notches 12*gs*, thereby preventing defect in bonding.

The respective dummy conductors 13*e*1 to 13*e*3 have the same width w (the length along the alignment direction) as the respective individual conductors 12*e*1 and 12*e*2 (see FIG. 5). In this case, it is possible to restrain variation in distributing the concavities and convexities due to the conductors 12*e*1, 12*e*2, and 13*e*1 to 13*e*3 in positions facing the bonding areas 15A1 and 15A2 in the alignment direction, thereby more evenly bonding the protection member 15 to the flow channel substrate 11. As a result, an even strength of bonding is obtainable in the alignment direction, thereby bringing in a better bonding of the protection member 15 to the flow channel substrate 11.

In the bonding area 18A of the COF 18, the width w (the length along the alignment direction) of the respective dummy conductors 13*e*1 to 13*e*3 is shorter than the width W of the respective individual conductors 12*e*1 and 12*e*2 including the individual contact points 12*f* (see FIG. 5). In this case, it is possible to prevent short circuit between the individual conductors 12*e*1 and 12*e*2 and the dummy conductors 13*e*1 to 13*e*3 by the positional deviation of the COF 18.

The convexoconcave 15*x* of the protection member 15 is formed on the surface facing the upper surface 11*b*1 of the pressure chamber plate 11*b* (see FIG. 4). In this case, the strength of bonding increases due to the anchor effect exerted by the concavity and convexity and the increase in the contact area with the adhesive A (see FIG. 4).

Such parts of the respective dummy conductors 13*e*1 to 13*e*3 as facing the bonding areas 15A1 and 15A2 have the same area as such parts of the respective individual conductors 12*e*1 and 12*e*2 as facing the bonding areas 15A1 and 15A2 (see FIG. 5). In this case, compared to the case where the parts of the respective dummy conductors 13*e*1 to 13*e*3 facing the bonding areas 15A1 and 15A2 differ in area from the parts of the respective individual conductors 12*e*1 and 12*e*2 facing the bonding areas 15A1 and 15A2, variation is restrained in the conductor distribution in areas facing the bonding areas 15A1 and 15A2, thereby bringing in a better bonding of the protection member 15 to the flow channel substrate 11.

Second Embodiment

Figure 6:
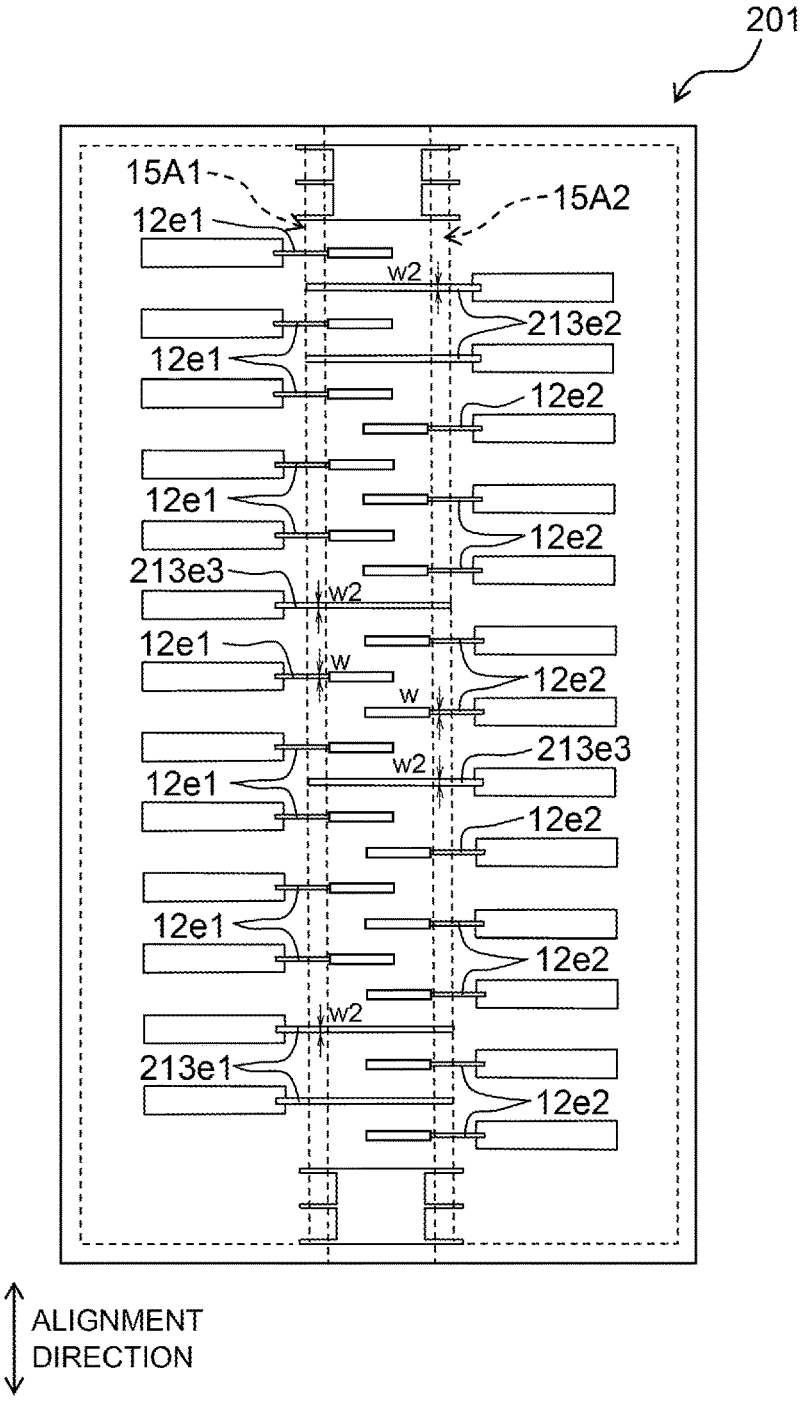
FIG. 6 is a plan view, corresponding to FIG. 5, of a head according to a second embodiment of the present teaching.

Next, referring to FIG. 6, an explanation will be made on a head 201 according to a second embodiment of the present teaching.

In the first embodiment, as shown in FIG. 5, the respective dummy conductors 13*e*1 to 13*e*3 in positions facing the bonding areas 15A1 and 15A2 have the same width w (the length along the alignment direction) as the respective individual conductors 12*e*1 and 12*e*2. In the second embodiment, however, as shown in FIG. 6, in the bonding areas 15A1 and 15A2, respective dummy conductors 213*e*1 to 213*e*3 have a width w2 which is larger than the width w of the respective individual conductors 12*e*1 and 12*e*2.

According to the second embodiment, with the larger width w2 of the respective dummy conductors 213*e*1 to 213*e*3, it is possible to increase the strength of bonding of the parts of providing the dummy conductors 213*e*1 to 213*e*3.

Third Embodiment

Figure 7:
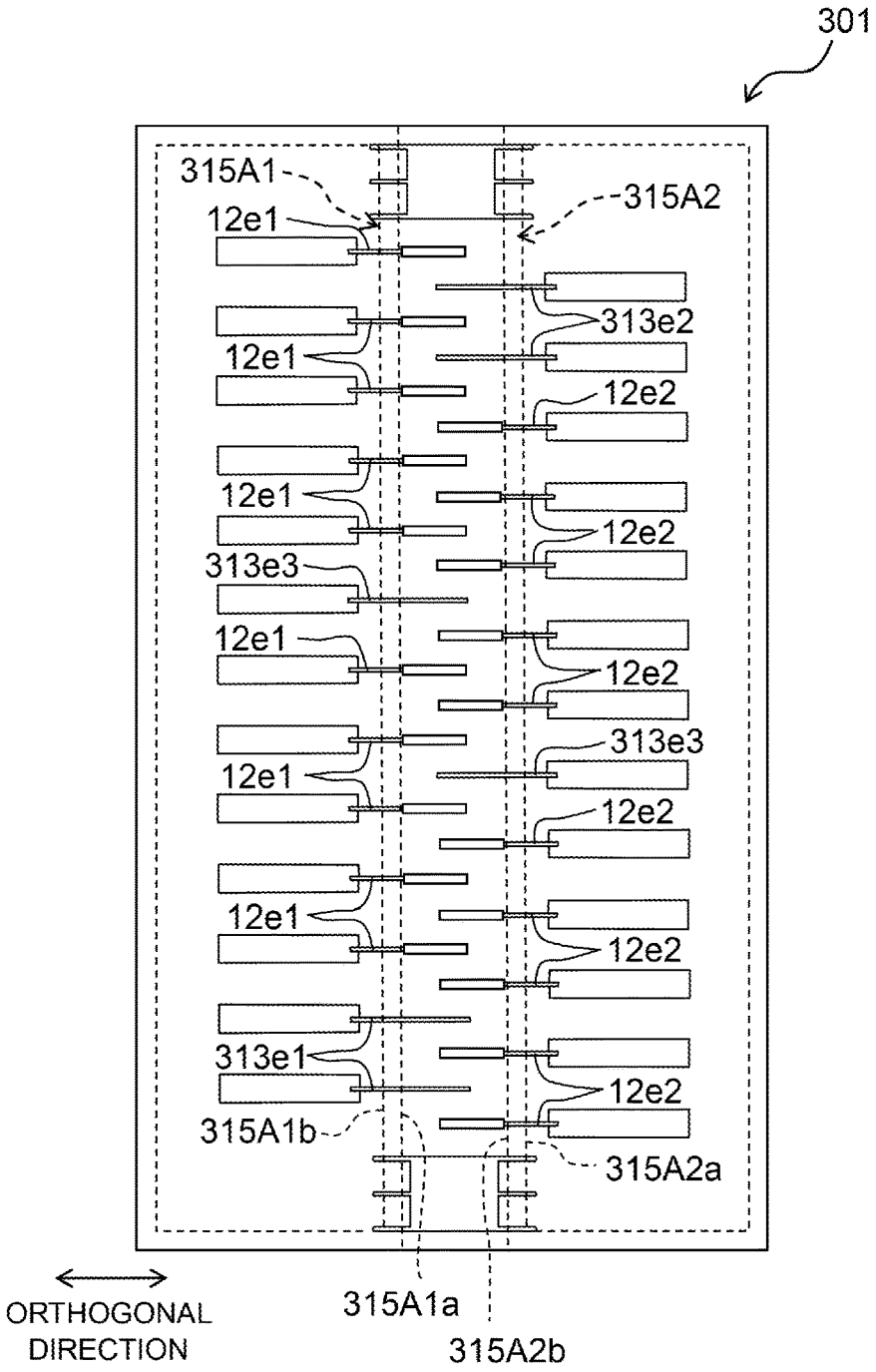
FIG. 7 is a plan view, corresponding to FIG. 5, of a head according to a third embodiment of the present teaching.

Next, referring to FIG. 7, an explanation will be made on a head 301 according to a third embodiment of the present teaching.

In the first embodiment, as shown in FIG. 5, the dummy conductors 13*e*1 to 13*e*3 extend across the first bonding area 15A1 and the second bonding area 15A2. In contrast to that, in the third embodiment, as shown in FIG. 7, dummy conductors 313*e*1 to 313*e*3 are shorter along the orthogonal direction than the dummy conductors 13*e*1 to 13*e*3 of the first embodiment, and do not extend across a first bonding area 315A1 and a second bonding area 315A2. The dummy conductors 313*e*1 to 313*e*3 have the same length in the orthogonal direction as the individual conductors 12*e*1 and 12*e*2, and extend from ends 315A1*a* and 315A2*a* of respective bonding areas 315A1 and 315A2 to other ends 315A1*b* and 315A2*b*.

According to the third embodiment, because the dummy conductors 313*e*1 to 313*e*3 have the same length along the orthogonal direction as the individual conductors 12*e*1 and 12*e*2, it is easy to form those conductors. Further, only the first dummy conductors 313*e*1 or only the second dummy conductors 313*e*2 are present in positions facing the respective bonding areas 315A1 and 315A2. Therefore, compared to the case of both the first dummy conductors 13*e*1 and the second dummy conductors 13*e*2 are present in the respective areas 15A1 and 15A2 (see FIG. 5), the conductors 12*e*1, 12*e*2, and 13*e*1 to 13*e*3 are avoided from bias in distribution. That is, between the parts provided with the individual conductors 12*e*1 and 12*e*2 and the parts provided with the dummy conductors 313*e*1 to 313*e*3, there is no bias in distribution of the conductors such that the conductors are evenly distributed. By virtue of this, it is possible to evenly exert the force on the bonding areas 315A1 and 315A2, thereby being less likely to have deviation in bonding.

Fourth Embodiment

Figure 8:
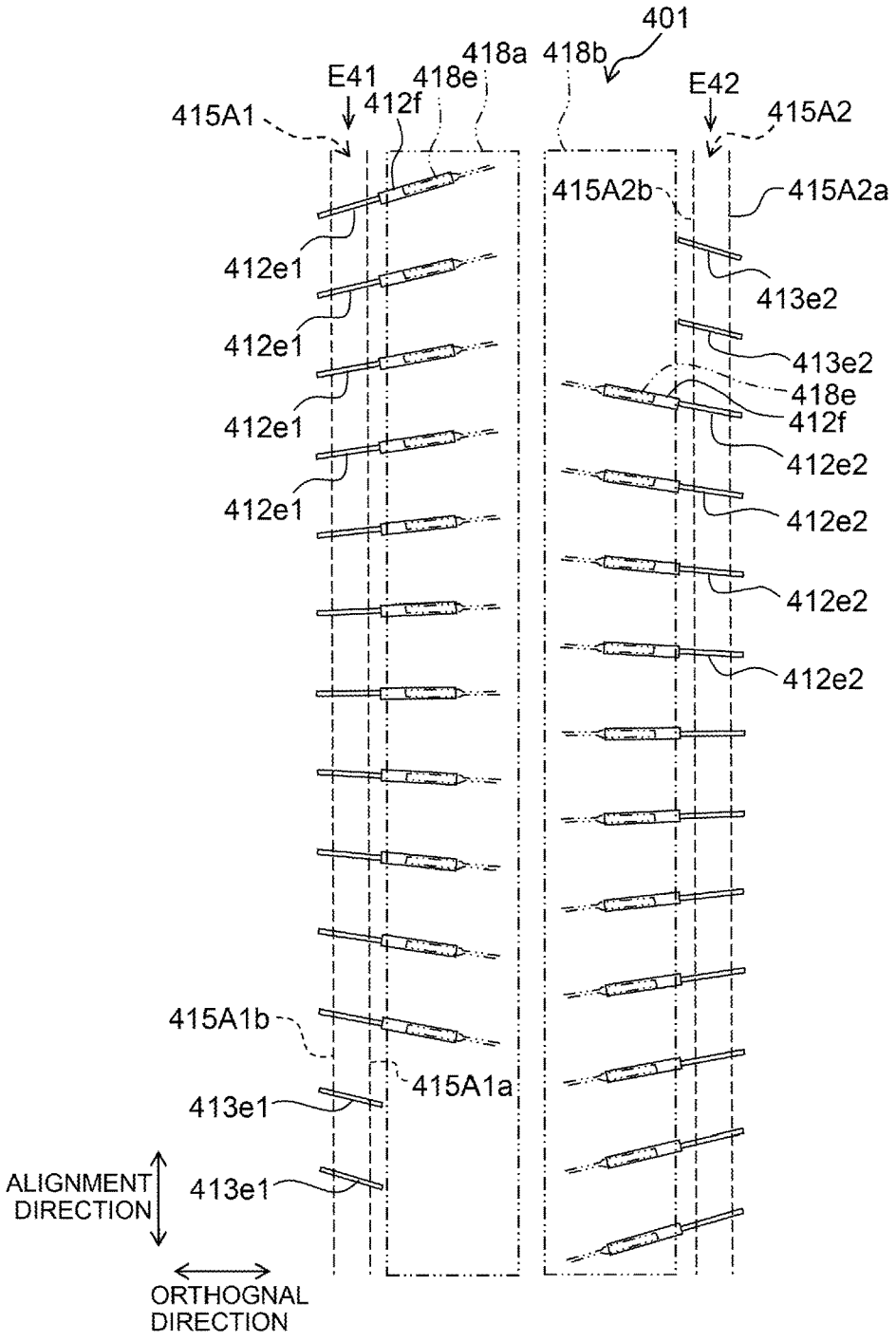
FIG. 8 is a plan view, corresponding to a central portion of FIG. 5, of a head according to a fourth embodiment of the present teaching.

Next, referring to FIG. 8, an explanation will be made on a head 401 according to a fourth embodiment of the present teaching.

As shown in FIG. 5, the individual conductors 12*e*1 and 12*e*2 and the dummy conductors 13*e*1 to 13*e*3 extend respectively in the orthogonal direction in the first embodiment. In the fourth embodiment, however, as shown in FIG. 8, individual conductors 412*e*1 and 412*e*2 and the dummy conductors 413*e*1 and 413*e*2 are arranged to spread radially. In particular, the first individual conductors 412*e*1 and the first dummy conductors 413*e*1 are arranged to spread radially in a direction from a first row E41 toward a second row E42. The second individual conductors 412*e*2 and the second dummy conductors 413*e*2 are arranged to spread radially in a direction from the second row E42 toward the first row E41. No dummy conductors are provided in the center of each of the rows E41 and E42 in the alignment direction.

In the first embodiment, as shown in FIG. 5, the dummy conductors 13*e*1 and 13*e*2 extend from the ends 15A1*a* and 15A2*a* of the respective bonding areas 15A1 and 15A2 to the other ends 15AA1*b* and 15A2*b* in the orthogonal direction, and extend across the first bonding area 15A1 and the second bonding area 15A2. In contrast to that, in the fourth embodiment as shown in FIG. 8, the dummy conductors 413*e*1 extend from an end 415A1*a* of a bonding area 415A1 to another end 415A1*b* in the orthogonal direction, while the dummy conductors 413*e*2 extend from an end 415A2*a* of a bonding area 415A2 to another end 415A2*b* in the orthogonal direction. However, the respective dummy conductors 413*e*1 and 413*e*2 do not extend across the first bonding area 415A1 and the second bonding area 415A2.

In the same manner as in the first embodiment, individual contact points 412*f* are formed at the fore-ends of the respective individual conductors 412*e*1 and 412*e*2. The individual contact points 412*f* are not formed at the fore-ends of the respective dummy conductors 413*e*1 and 413*e*2.

In the first embodiment, one COF 18 is connected with the individual contact points 12*f* connected to the first individual conductors 12*e*1 forming the first row E1, and with the individual contact points 12*f* connected to the second individual conductors 12*e*2 forming the second row E2. In contrast to that, in the fourth embodiment, two COFs 418*a* and 418*b* are connected individually with contact points 412*f* connected to the first individual conductors 412*e*1 forming the first row E41, and with contact points 412*f* connected to the second individual conductors 412*e*2 forming the second row E42.

When the COFs 418*a* and 418*b* are bonded, the COFs 418*a* and 418*b* will contract to cause wires 418*e* of the COFs 418*a* and 418*b* to change in position. Hence, such a problem may arise that the wires 418*e* cannot be connected electrically with the individual conductors 412*e*1 and 412*e*2. In this regard, according to the fourth embodiment, the individual conductors 412*e*1 and 412*e*2 are arranged radially. Therefore, the wires 418*e* of the COFs 418*a* and 418*b* are arranged likewise radially such that even if the COFs 418*a* and 418*b* contract to cause the wires 418*e* change in position, it is still possible to electrically connect the wires 418*e* with the individual conductors 412*e*1 and 412*e*2 by adjusting the positions of the COFs 418*a* and 418*b* in the orthogonal direction. Then, in such a manner, if the dummy conductors 413*e*1 and 413*e*2 are arranged radially, imitating the individual conductors 412*e*1 and 412*e*2, and provided in the respective bonding areas 415A1 and 415A2, then it is possible to attain a good bonding of the protection member 15 to the flow channel substrate 11.

While a few preferred embodiments of the present teaching were explained hereinabove, the present teaching is not limited to the embodiments described above, but can have various design changes and/or modifications without departing from the true scope and spirit set forth in the appended claims.

[Modifications]

As far as the dummy conductors do not contribute to the drive of the actuator, they may or may not be connected electrically with the actuator. The dummy conductors may not extend to the outside of the area of bonding the bonding member but be arranged within the areas of bonding the bonding member. The dummy conductors may not extend from one end to the other end in positions facing the bonding areas in the orthogonal direction, but be arranged in at least partially in positions facing the bonding areas. The numbers of the first dummy conductors and the second dummy conductors are respectively two in the above embodiments. However, the numbers may be respectively one or more. In positions facing the bonding area of the bonding member, the dummy conductors may have a smaller width (the length along the alignment direction) than the individual conductors. In the bonding area of the wiring substrate, the dummy conductors may be as wide as or wider than the individual conductors. If in positions facing the bonding area of the bonding member, the dummy conductors have the same areas as the individual conductors, then the dummy conductors may differ in shape from the individual conductors. In positions facing the bonding area of the bonding member, the dummy conductors may differ in area from the individual conductors.

It is possible to omit the dummy conductors 13*e*3 provided in the center of the respective rows E1 and E2 in the alignment direction in the first embodiment (see FIG. 5). In such a case, between the one end portion (area A1) in the alignment direction and the other end portion (area A2) in the alignment direction, the area A4 of aligning the dummy conductors 13*e*3 is not formed whereas only the area A3 is formed to align the first individual conductors 12*e*1 and the second individual conductors 12*e*2 alternately in the alignment direction.

In the first embodiment (see FIG. 5), the two rows E1 and E2 of the individual conductors are arranged between the two individual electrode rows D1 and D2. However, without being limited to that, for example, the two rows E1 and E2 of the individual conductors may be arranged at one side or at the other side of the two individual electrode rows D1 and D2 in the orthogonal direction.

In the fourth embodiment (see FIG. 8), the first individual conductors 412*e*1 and the first dummy conductors 413*e*1 are arranged to spread radially in the direction from the first row E41 to the second row E42 while the second individual conductors 412*e*2 and the second dummy conductors 413*e*2 are arranged to spread radially in the direction from the second row E42 to the first row E41. However, without being limited to that, for example, both the group of the first individual conductors 412*e*1 and the first dummy conductors 413*e*1 and the group of the second individual conductors 412*e*2 and the second dummy conductors 413*e*2 may be arranged to spread radially either in the direction from the first row E41 toward the second row E42 or in the direction from the second row E42 toward the first row E41. In this case, such a configuration may be adopted that one COF is connected to the individual contact points 412*f* connected to the first individual conductors 412*e*1 forming the first row E41, and to the individual contact points 412*f* connected to the second individual conductors 412*e*2 forming the second row E42. Then, by adjusting the position of that COF in the orthogonal direction, it is possible to secure the reliability in the electrical connection between the wires and the individual conductors.

The individual conductors, the dummy conductors, and the common conductor may not be aligned at regular intervals in the alignment direction. For example, the interval along the alignment direction between the common conductor and the individual conductors or dummy conductors adjacent to the common conductor in the alignment direction may differ from the interval along the alignment direction between the individual conductors and the dummy conductors. Further, the individual conductors and the dummy conductors may not be aligned at regular intervals along the alignment direction. For example, the interval along the alignment direction between the dummy conductors and the individual conductors adjacent to the dummy conductors in the alignment direction may differ from the interval along the alignment direction between the corresponding individual conductors.

The interval along the alignment direction between the corresponding terminals of the common conductor may differ from the interval along the alignment direction between the corresponding individual conductors. The notches may not be formed in the common conductor to extend between the plurality of terminals in the orthogonal direction, and the interspaces between the terminals may be closed. The bonding area of the bonding member may be in contact with other parts than the terminals of the common conductors. The common conductor may not have a plurality of terminals. The bonding area of the bonding member may not contact with the common conductor.

The concavities and convexities of the bonding member may not be formed on the surface facing the surface of the actuator substrate. The protection member 15 is exemplified as the bonding member in the above embodiments (see FIG. 3) to protect the actuator unit 12. However, without being limited to that, for example, the bonding member may be formed with a flow channel as in the reservoir member 11*a*.

The first individual conductors and the second individual conductors overlap in the orthogonal direction in the above embodiments (see FIG. 5). However, they may not overlap in the orthogonal direction. The pressure chambers and/or nozzles may be formed in positions facing the dummy electrodes. The dummy electrodes and the opposed piezoelectric bodies may be omitted.

The actuator is not limited to the piezo method using the piezoelectric elements as in the above embodiments, but may be of other methods (such as a thermal method using heater elements, an electrostatic method using electrostatic force, and the like).

In the liquid jet head, the plurality of nozzles are not limited to being aligned to form acute angles with the conveyance direction, but may be aligned in a direction orthogonal to the conveyance direction. However, as in the above embodiments (see FIG. 2), if the heads are juxtaposed to align the plurality of nozzles form the acute angle θ with the conveyance direction, then the dots formed of the ink jetted from the nozzles of one head align in a direction orthogonal to the conveyance direction with the dots formed of the ink jetted from the nozzles of another head adjacent to the former head. In such a case, if some bonding defect occurs in the end portions to be the joints between the heads along the alignment direction, then it is possible to give rise to interspaces between the dots, thereby forming white stripes. In this regard, however, according to the present teaching, it is possible to restrain bonding defect, thereby preventing the white stripes.

The liquid jet head is not limited to jetting the four color inks but may jet, for example, a single color ink (only the black), or two color inks. The liquid jet head is not limited to a line type but may be of a serial type (such as a type of causing the head to scan along a direction orthogonal to the conveyance direction while jetting a liquid on a recording medium conveyed along the conveyance direction). Further, the liquid jet apparatus is not limited to having a head unit including a plurality of liquid jet heads, but may have a single liquid jet head. The liquid jetted by the liquid jet head is not limited to ink but may be any liquid (such as a treatment liquid or the like agglutinating or precipitating the ingredients of the ink). The recording medium is not limited to paper but may be any recordable medium (such as cloth or the like). The present teaching is not limited to printers but may also be applied to facsimiles, copy machines, multifunction peripheries, and the like.

What is claimed is:

1. An actuator device comprising:

an actuator substrate having actuators, individual conductors electrically connected with the actuators respectively, and dummy conductors; and a bonding member bonded to a surface of the actuator substrate provided with the individual conductors and the dummy conductors, wherein the individual conductors are aligned in an alignment direction to form a first row and a second row which are arranged in an orthogonal direction orthogonal to the alignment direction, in a first end portion of the actuator substrate on one side in the alignment direction, first individual conductors are aligned in the alignment direction without intervening second individual conductors therebetween, the first individual conductors being included in the individual conductors and forming the first row, the second individual conductors being included in the individual conductors and forming the second row, in a second end portion of the actuator substrate on the other side in the alignment direction, the second individual conductors are aligned in the alignment direction without intervening the first individual conductors therebetween, in an area of the actuator substrate between the first end portion and the second end portion in the alignment direction, the first individual conductors and the second individual conductors are aligned alternately in the alignment direction, the dummy conductors include a first dummy conductor provided on the other side of the first individual conductors in the alignment direction, and a second dummy conductor provided on the one side of the second individual conductors in the alignment direction, a bonding area, of the bonding member, bonded to the surface includes a first bonding area and a second bonding area arranged in the orthogonal direction, the first bonding area is in contact with the first individual conductors and the first dummy conductor, and the second bonding area is in contact with the second individual conductors and the second dummy conductor.

2. The actuator device according to claim 1, wherein the first dummy conductor is in contact with an end portion of the first bonding area on the other side in the alignment direction, and the second dummy conductor is in contact with an end portion of the second bonding area on the one side in the alignment direction.

3. The actuator device according to claim 2, wherein the first dummy conductor extends in the orthogonal direction from one end of the first bonding area to the other end of the first bonding area, and the second dummy conductor extends in the orthogonal direction from one end of the second bonding area to the other end of the second bonding area.

4. The actuator device according to claim 1, wherein each of the first dummy conductor and the second dummy conductor extends across the first bonding area and the second bonding area.

5. The actuator device according to claim 1, wherein in a position facing the bonding area of the bonding member, the dummy conductors and the individual conductors have the same length along the alignment direction.

6. The actuator device according to claim 1, wherein in a position facing the bonding area of the bonding member, a length of each of the dummy conductors along the alignment direction is longer than a length of each of the individual conductors along the alignment direction.

7. The actuator device according to claim 1, further comprising a wiring substrate bonded to the surface of the actuator substrate, wherein in a position facing a bonding area of the wiring substrate, a length of each of the dummy conductors along the alignment direction is shorter than a length of each of the individual conductors along the alignment direction.

8. The actuator device according to claim 1, wherein a surface of the bonding member facing the surface of the actuator substrate has concavity and convexity formed thereon.

9. The actuator device according to claim 1, wherein in a position facing the bonding area of the bonding member, an area of each of the dummy conductors is the same as an area of each of the individual conductors.

10. The actuator device according to claim 1, wherein the first individual conductors and the first dummy conductor are arranged to spread radially in a direction from the first row to the second row, and the second individual conductors and the second dummy conductor are arranged to spread radially in a direction from the second row to the first row.

11. The actuator device according to claim 1, wherein each of the individual conductors is supplied with a drive signal for driving one of the actuators corresponding thereto, and each of the dummy conductors is not supplied with the drive signal.

12. The actuator device according to claim 1, wherein the individual conductors and the dummy conductors are aligned at regular intervals in the alignment direction.

13. The actuator device according to claim 12, wherein the actuator substrate further has a common conductor which is electrically connected with the actuators and is provided at least at one of the other side of the first dummy conductor in the alignment direction and the one side of the second dummy conductor in the alignment direction, and the first bonding area and the second bonding area of the bonding member are further in contact with the common conductor.

14. The actuator device according to claim 13, wherein the individual conductors, the dummy conductors, and the common conductor are aligned at regular intervals in the alignment direction.

15. The actuator device according to claim 14, wherein the common conductor includes terminals separated from each other in the alignment direction, and the first bonding area and the second bonding area are in contact with the terminals.

16. The actuator device according to claim 15, wherein the interval along the alignment direction between the individual conductors is the same as the interval along the alignment direction between the terminals.

17. The actuator device according to claim 16, wherein the common conductor has a notch formed to extend in the orthogonal direction between the terminals.

* * * * *